US012270220B2

(12) United States Patent
Coleman

(10) Patent No.: US 12,270,220 B2
(45) Date of Patent: Apr. 8, 2025

(54) ASSEMBLY TOOL FOR A FENCE

(71) Applicant: Jennifer J. Coleman, Paris, KY (US)

(72) Inventor: Jennifer J. Coleman, Paris, KY (US)

( * ) Notice: Subject to any disclaimer, the term of this patent is extended or adjusted under 35 U.S.C. 154(b) by 428 days.

(21) Appl. No.: 17/818,947

(22) Filed: Aug. 10, 2022

(65) Prior Publication Data

US 2023/0128745 A1 Apr. 27, 2023

(51) Int. Cl.
*E04H 17/26* (2006.01)
*E04H 17/14* (2006.01)

(52) U.S. Cl.
CPC ..... *E04H 17/26* (2013.01); *E04H 17/1413* (2013.01)

(58) Field of Classification Search
CPC ..... E04H 17/00; E04H 17/14; E04H 17/1413; E04H 17/1447; E04H 17/146; E04H 17/1473; E04H 17/1488; E04H 17/20; E04H 17/21; E04H 17/26
See application file for complete search history.

(56) References Cited

U.S. PATENT DOCUMENTS 108,925 A * 11/1870 Middleton ..... E04H 17/1488 256/24
124,105 A * 2/1872 Wilson ..... E04H 17/1439 256/22
183,601 A * 10/1876 Stover ..... E04H 17/1413 256/48
265,518 A * 10/1882 Landis ..... E04H 17/1447 256/62
351,050 A * 10/1886 Hanika ..... E04H 17/1413 256/68
402,678 A * 5/1889 Lathrop ..... E04H 17/1413 256/29
3,082,843 A * 3/1963 Henderson ..... E04G 5/045 182/113
3,747,898 A * 7/1973 Warren ..... E04G 21/3242 248/231.51
4,666,131 A * 5/1987 Kettelkamp, Sr. ..... E04G 5/041 182/113
4,899,991 A * 2/1990 Brunkan ..... E04H 17/1447 256/65.06
5,456,451 A * 10/1995 Eyler, Jr. ..... E04G 21/3223 256/65.06
5,645,271 A * 7/1997 Nunez ..... E04H 12/2276 256/65.14
5,938,184 A * 8/1999 DeSouza ..... E04H 17/1417 256/65.06

(Continued)

*Primary Examiner* — Jonathan P Masinick
(74) *Attorney, Agent, or Firm* — Faegre Drinker Biddle & Reath LLP

(57) ABSTRACT

A fence assembly tool is provided. The fence assembly tool may be an auxiliary tool that is removably coupled to a first fence post, to assist an individual in assembling fences. Specifically, the fence assembly tool may include an elongate body that includes one or more brackets extending therefrom. Each of the one or more brackets may be adapted to receive a first end of a cross member of a fence assembly. A second opposing end of the cross member may then be coupled to a second fence post while remaining supported at the first end by the assembly tool. This process may be repeated for multiple cross members as needed, thereby allowing a user to assemble or repair a fence without assistance from others.

20 Claims, 14 Drawing Sheets

(56) References Cited

U.S. PATENT DOCUMENTS

| | | | | |
|---|---|---|---|---|
| 6,038,829 | A * | 3/2000 | Franks | E04G 21/3242 52/645 |
| 6,039,150 | A * | 3/2000 | Palmer | E04G 21/3223 182/113 |
| 6,902,152 | B1 * | 6/2005 | Clifford | E04H 17/1413 256/65.01 |
| 8,132,792 | B2 * | 3/2012 | Perris | E04G 21/3223 182/113 |
| 8,448,923 | B1 * | 5/2013 | Schad | E04G 21/3219 256/65.03 |
| 9,371,666 | B2 * | 6/2016 | Allen | E04G 5/062 |
| 9,493,959 | B2 * | 11/2016 | Gutierrez | E04F 11/1865 |
| 9,601,036 | B2 * | 3/2017 | Barnard, IV | G09F 19/226 |
| 10,428,554 | B2 * | 10/2019 | Johns | E04H 17/124 |
| D917,077 | S * | 4/2021 | Henderson | E04F 11/181 D25/126 |
| 11,236,511 | B2 * | 2/2022 | Henderson | E04H 17/20 |
| 11,781,337 | B2 * | 10/2023 | Beisser, III | E04H 17/10 256/65.03 |
| 11,859,400 | B2 * | 1/2024 | Munir | E04H 17/1473 |
| 2005/0285091 | A1 * | 12/2005 | Ko | E04H 17/1488 256/24 |
| 2006/0214149 | A1 * | 9/2006 | Hung | E04H 17/1447 256/22 |
| 2020/0270895 | A1 * | 8/2020 | Stinson | E04H 17/06 |
| 2022/0251871 | A1 * | 8/2022 | Dunne | E04H 17/1447 |

* cited by examiner

ASSEMBLY TOOL FOR A FENCE

BACKGROUND

Fences may be used in a variety of contexts. In some examples, fences may include a plurality of fence posts, such as a first fence post and a second fence post. The fences may further include cross members that extend from the first fence post to the second fence post, after being coupled thereto.

SUMMARY

Aspects of the present disclosure relate generally to a fence assembly tool. The fence assembly tool may be an auxiliary tool that is removably coupled to a first fence post, to assist an individual in assembling fences. Specifically, the fence assembly tool may include an elongate body that includes one or more brackets extending therefrom. Each of the one or more brackets may be adapted to receive a first end of a cross member of a fence assembly. A second opposing end of the cross member may then be coupled to a second fence post while remaining supported at the first end by the assembly tool. This process may be repeated for multiple cross members as needed, thereby allowing a user to assemble or repair a fence without assistance from others.

In some examples an assembly tool for a fence is provided. The assembly tool includes an elongate body, a base, and one or more brackets that extend from the elongate body. The base is attached to the elongate body. Each of the one or more brackets are sized and configured to receive a corresponding one of one or more cross members of a fence assembly.

In some examples, an assembly tool is provided. The assembly tool includes an elongate body, a handle, and one or more brackets. The handle extends from the elongate body. The one or more brackets extend from the elongate body. Further, each of the one or more brackets are sized and configured to receive a corresponding one of one or more cross members of a fence assembly.

In some examples, an assembly tool is provided. The assembly tool includes an elongate body, a strap, and one or more brackets. The strap is coupled to the elongate body, and the strap is configured to removably coupled the elongate body to a fence post. The one or more brackets extend from the elongate body. Further, each of the one or more brackets are adapted to receive a corresponding one of one or more cross members of a fence assembly.

In some examples, a height of each of the one or more brackets are adjustable, along the elongate body, with respect to the base.

In some examples, the elongate body is made from one of metal, wood, or plastic.

In some examples, the base is integrally attached to the elongate body.

In some examples, the one or more brackets are coupled to the elongate body, via one or more fasteners.

In some examples, the elongate body includes a plurality of holes that extend therethrough. Each of the plurality of holes are configured to receive one or more fasteners to secure the one or more brackets to the elongate body.

In some examples, the elongate body is substantially hollow.

In some examples, the one or more brackets include a plurality of brackets that are each adapted to receive a corresponding one of a plurality of cross members of a fence assembly.

In some examples, the elongate body includes a first face and a second face. The first face and the second face are laterally opposed on the elongate body, and the one or more brackets each define a flange that extends outward from the first face.

In some examples, each of the one or more flanges define, in combination with the elongate body, an elongate pocket.

In some examples, a method for assembling a fence, using the assembly tool, is provided. The method includes: coupling the assembly tool to a first fence post, inserting a first end of one of the one or more cross members into a first elongate pocket of the one or more elongate pockets, coupling a second end of the one or more cross members to a second fence post, de-coupling the assembly tool from the first fence post, and coupling the first end of the one of the one or more cross members to the first fence post.

In some examples, the assembly tool further includes a strap. The strap is coupled to the elongate body, and the strap is configured to removably couple the elongate body to a fence post.

In some examples, the strap is one of a cinch strap or a fabric strap with hook-and-loop fasteners.

In some examples, the assembly tool further includes a handle. The handle extends from the elongate body, opposite of the base.

In some examples, a height from the base to the handle is between about 4 feet and about 6 feet.

This summary is provided to introduce a selection of concepts in a simplified form that are further described below in the Detailed Description. This summary is not intended to identify key features or essential features of the claimed subject matter, nor is it intended to be used to limit the scope of the claimed subject matter. Additional aspects, features, and/or advantages of examples will be set forth in part in the following description and, in part, will be apparent from the description, or may be learned by practice of the disclosure.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, where.

Corresponding reference characters may indicate corresponding parts throughout the several views. Unless stated otherwise the drawings are proportional and drawn to scale.

DETAILED DESCRIPTION OF THE DRAWINGS

Figure 1:
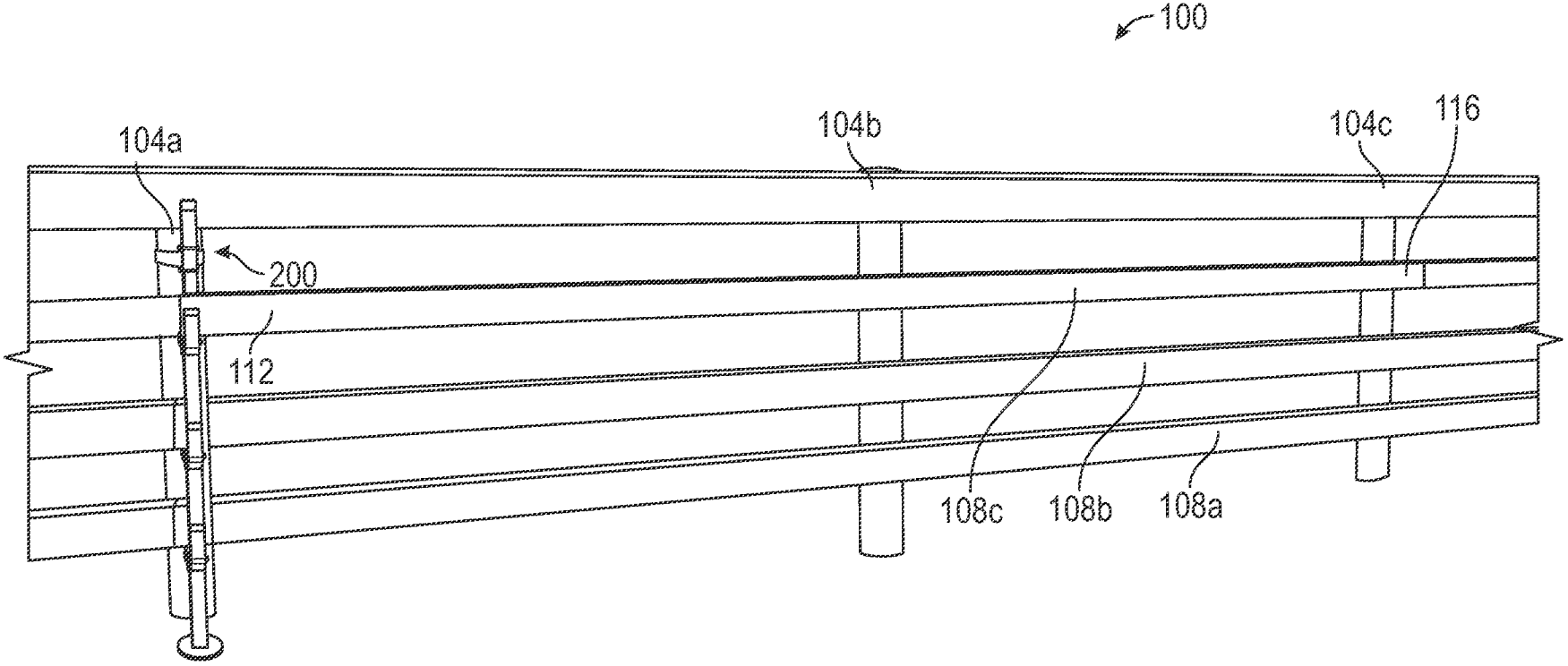
FIG. 1 illustrates a front perspective view of a fence assembly being assembled, using an assembly tool, according to some aspects described herein.

It is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

While the structures and components disclosed herein may be embodied in many different forms, several specific embodiments are discussed herein with the understanding that the embodiments described in the present disclosure are to be considered only exemplifications of the principles described herein, and the disclosure is not intended to be limited to the embodiments illustrated. Further, throughout the disclosure, the terms "about", "substantially", and "approximately" mean plus or minus 5% of the number or geometric constraint that each term precedes. For example, about 100 may mean 100+/−5. Additionally, or alternatively, substantially orthogonal may mean that any 90 degree angle related to the described orthogonality may be between 85.5 degrees and 94.5 degrees (inclusive).

Fences may be used in a variety of contexts. For example, fences may be used to define boundaries of a person's property. Additionally, or alternatively, fences may be used to keep-in or keep-out various forms of life (e.g., wild animals, farm animals, domestic animals, humans, etc.). Additionally, or alternatively, fences may be used for aesthetic appeal, such as, for example, in the form of the iconic white picket fence that is often tied to the American Dream, the same American Dream that promotes innovation and ingenuity, as may be exemplified by mechanisms described herein.

In many instances, fences may contribute to fundamental rights with which a person is endowed. As a first example, fences may provide individuals with protection (e.g., to protect life), such as from trespassers or wildlife. As a second example, fences may provide individuals with privacy (e.g., one of many liberties), such as from neighbors or travelers. Further, fences may improve a person's quality of life (e.g., for a person's own pursuit of happiness), with ornamental designs that help to beautify a person's property.

However, fences can be difficult to assemble. In some examples, fences may include cross members that extend from a first fence post to a second fence post. The cross members may be as long as, or in some instances even longer than, 16 feet. An installer is unable to hold up both ends of a cross member (e.g., a 16-foot long cross member) to couple the cross member to both a first fence post and a second fence post. Therefore, two people may be needed to assemble most fences. A first person may couple a first end of the cross member to the first fence post, while a second person couples a second end of the cross member to the second fence post. Unfortunately, it may be difficult, if not impossible, for a person to assemble a fence, by coupling cross members to fence posts, by themselves.

Accordingly, there exists a need for an auxiliary tool that individuals can use to assemble fences (e.g., couple cross members across fence posts), relatively easily, by themselves. Further, to accommodate a diversity of fences, there exists a need for an auxiliary tool that can be used to assemble cross members with varying heights. Further, there exists a need for an auxiliary tool that an individual can use to hold a cross member with enough stability for the individual to trim the cross member easily and safely (e.g., with a saw, such as a hand saw), if needed.

Aspects of the present disclosure can be advantageous to address the above problems, as well as additional problems that may be recognized by those of ordinary skill in the art. Although relatively specific problems may have been discussed, it should be understood that the embodiments should not be limited to solving the specific problems identified herein.

Generally, as explained further herein, the present disclosure provides a fence assembly tool. The fence assembly tool includes an elongate body and one or more brackets extending from the elongate body. Each of the one or more brackets are adapted to receive one or more corresponding cross members of a fence assembly. In some examples, the fence assembly tool further includes a base. The base is attached to the elongate body. In some examples, the fence assembly tool further includes a handle. The handle extends from the elongate body. Further, in some examples, the fence assembly tool further includes a strap. The strap can be coupled to the elongate body, and the strap can be configured to removably couple the elongate body to a fence post.

Aspects of the fence assembly tool described herein provide the ability for a person to easily couple a cross member from a first fence post to a second fence post, by themselves. Further, aspects of the fence assembly tool provide a sturdy and stable structure for holding a cross member, such that the cross member can be easily trimmed by a person (e.g., with a saw, such as a hand saw), if needed, by themselves. Further advantages of the fence assembly tool described herein may be recognized by those of ordinary skill in the art, at least in light of the teachings included herein.

FIG. 1 illustrates a front perspective view of a fence assembly 100 being assembled, using an assembly tool or fence assembly tool or tool 200. In the example of FIG. 1, the fence assembly 100 includes a plurality of posts 104, such as a first post 104*a*, a second post 104*b*, and a third post 104*c*. The fence assembly 100 further includes one or more cross members 108, such as a first cross member 108*a*, a second cross member 108*b*, and a third cross member 108*c*. Each of the one or more cross members 108 may have a first end 112 and a second end 116. The first end 112 may be opposite to the second end 116. In other words, the first end 112 and the second end 116 may be laterally opposed.

The fence assembly tool 200 may be removably coupled to the first post 104*a*. The fence assembly tool 200 may be removably coupled using mechanisms described herein and/or using mechanisms that may be recognized by those of ordinary skill in the art. The third cross member 108*c*, as shown in FIG. 1, may be coupled to one or more of the one or more posts 104 (e.g., the second post 104*b* and the third post 104*c*), using the fence assembly tool 200. The first end 112 of the third cross member 108*c* may be received by the fence assembly tool 200. Therefore, one or more aspects of the fence assembly tool 200 may be configured, adapted, and/or dimensioned to receive one or more of the one or more cross members 108. Further, the second end 116 of the third cross member 108*c* may be coupled to an adjacent one of the other posts (e.g., the second post 104*b* or the third post 104*c*).

After coupling the second end 116 of the third cross member 108*c* to one the posts 104, the cross member 108*c* may also be coupled to any intermediate posts 104 positioned along its length (e.g., post 104*b* shown in FIG. 1). The fence assembly tool 200 may then be de-coupled from the first post 104*a* and/or removed from the third cross member 108*c*. The first end 112 of the third cross member 108*c* may then be coupled to the first post 104*a*. Additionally, or alternatively, while the third cross member 108*c* is being held by the fence assembly tool 200, a person may be able to trim a length of the third cross member 108*c*, such as, for example with a saw.

Generally, the fence assembly tool 200 allows for one or more cross members to be assembled (e.g., coupled) with one or more fence posts, by a single person. Therefore, the fence assembly tool 200 eases assembly of fence assemblies (e.g., fence assembly 100) for independent individuals. Further, the fence assembly tool 200 provides a sturdy and stable structure for holding a cross member (e.g., the third cross member 108*c*), such that the cross member can be easily trimmed by a person (e.g., with a saw, such as a hand saw), if needed, by themselves. Further advantages of the fence assembly tool described herein may be recognized by those of ordinary skill in the art, at least in light of the teachings included herein.

Figure 2:
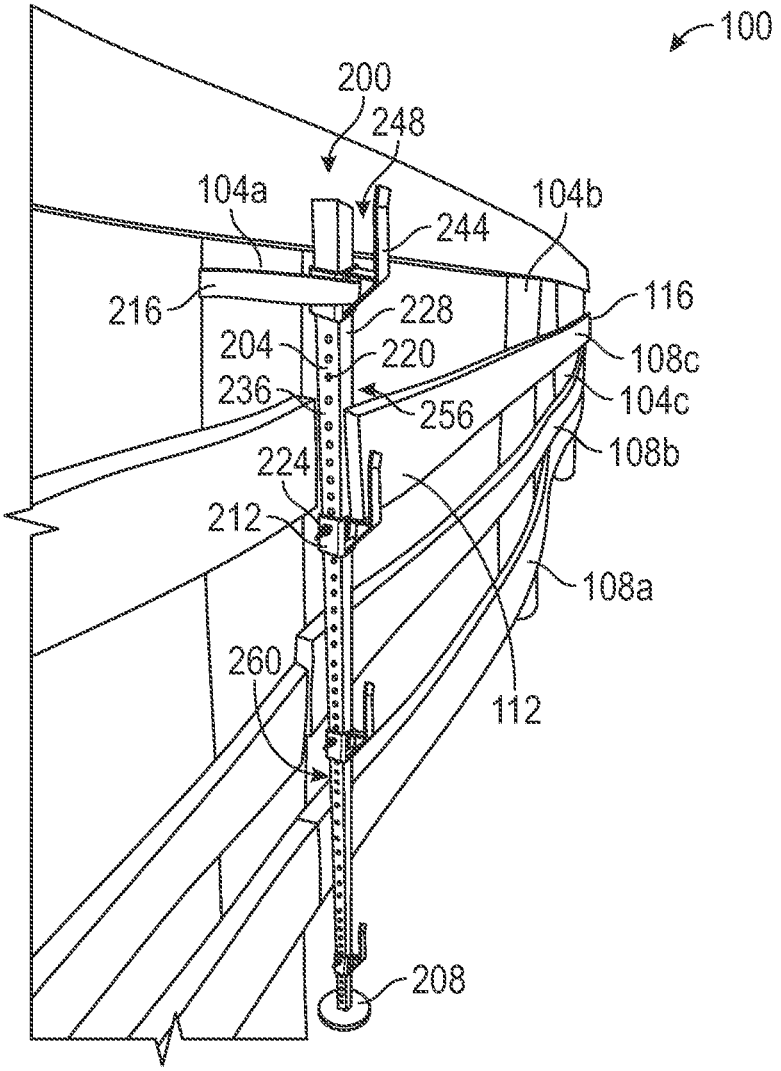
FIG. 2 illustrates a front, right-side perspective view of a fence assembly being assembled, using the assembly tool of FIG. 1, according to some aspects described herein.
Figure 3:
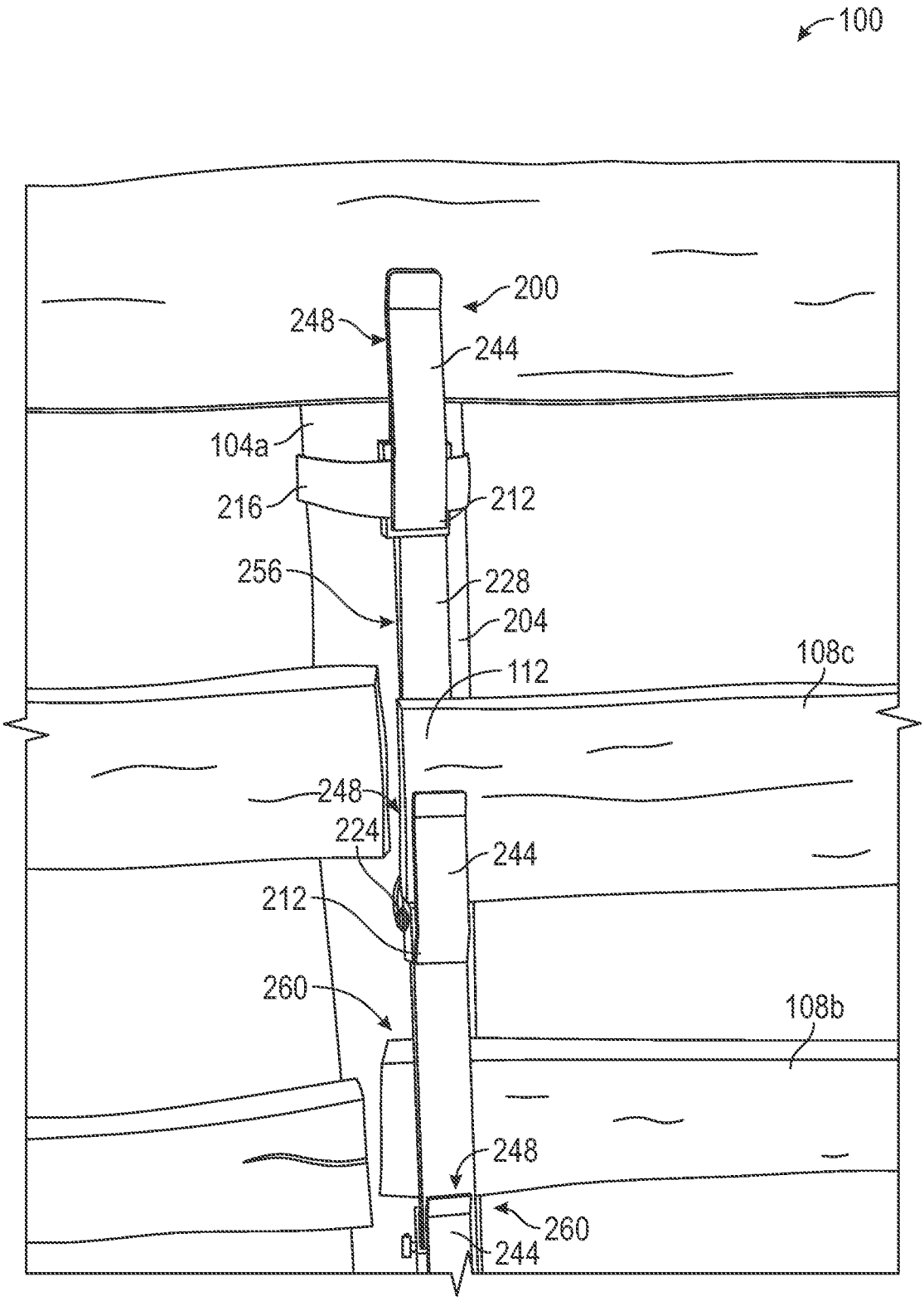
FIG. 3 illustrates a front perspective view of a portion of a fence assembly being assembled, using the assembly tool of FIG. 1, according to some aspects described herein.

FIGS. 2 and 3 illustrate additional views of the fence assembly 100 being assembled, using the fence assembly tool 200. As shown in FIG. 2, the fence assembly tool 200 includes an elongate body 204, a base 208, one or more brackets 212, and/or a strap 216.

The elongate body 204 may generally form a rectangular prism. Alternatively, the elongate body 204 may generally form a cylinder or bar, or another elongated volumetric shape that may be recognized by those of ordinary skill in the art. Additionally, and/or alternatively, the elongate body 204 may be hollow, along at least a portion of a length of the elongate body 204. Alternatively, the elongate body 204 may be substantially hollow (e.g., hollow along a first length of the elongate body 204 that is greater than a second length of the elongate body 204, along which the elongate body 204 is not hollow). In some examples, the elongate body 204 may be hollow along an entire length of the elongate body 204. In some examples, an advantage of the fence assembly tool 200 is that individuals may be able to use the tool 200 to assemble fences, by themselves. Therefore, it may be beneficial for the elongate body 204 to be hollow, to reduce weight for an individual who is carrying the tool 200 (e.g., outdoors, for long periods of time, and/or over long distances), to assemble fences, by themselves.

In one embodiment, the elongate body 204 may be made from a rigid material such as one of metal, wood, or plastic. Additionally, and/or alternatively, the elongate body 204 may be made from a composite material that combines at least one or more from the group of metal, wood, and plastic. The rigidity of the material for body 204 may be sufficient to support the weight of a cross member 108 (FIG. 1) with minimal deflection and/or deformation, such a total deflection of less than 1 inch, for example. Any such deflection may be elastically recoverable, i.e., the body 204 reverts from its deflected shape to its original shape when the weight is removed. Further, the elongate body 204 may include a plurality of holes 220 extending therethrough. Each of the plurality of holes 220 may be configured to receive one or more fasteners 224 to secure the one or more brackets 212 to the elongate body 204, as further detailed below.

In some examples, the one or more fasteners 224 may each be one or more pins, such as cotter pins, that extend through a respective one of the one or more brackets 212, and corresponding holes 220. Thus, a fastener 224 couples each of the one or more brackets 212 to the elongate body 204. Additionally, or alternatively, the one or more fasteners 224 may be screws and/or bolts that couple each of the one or more brackets 212 to the elongate body 204. Additionally, or alternatively, the one or more brackets may be otherwise coupled to the elongate body 204, such as, for example, via adhesion, welding, molding, or other attachment mechanisms that may be recognized by those of ordinary skill in the art.

The plurality of holes 220 may be equally spaced apart along a length of the elongate body 204. For example, the plurality of holes 220 may be spaced apart at a distance of between about one inch and about two inches. Additionally, or alternatively, the plurality of holes 220 may be spaced apart at configurable distances, with respect to each other, that are determined to be preferable for a user of the fence assembly tool 200. One of ordinary skill in the art may recognize that vertical spacing between a first cross member of a fence assembly and a second cross member of the fence assembly can vary depending on a number of cross members that are coupled to the fence assembly, thereby impacting a distance at which the plurality of holes 220 may be spaced apart to position the brackets 212 along the elongate body 204.

In some examples, fence assemblies may have only a single cross member extending between a first post and a second post, whereas in alternative examples, fence assemblies may have two cross members, or three cross members, or four cross members, or five cross members, or any number of cross members. On a conventional five-foot tall fence, there may be four cross members that are vertically spaced apart a distance of between about 10 inches and about 12 inches. However, if five-foot tall fence includes, instead, only three cross members, then the three cross members may be vertically spaced apart a distance of greater than about 12 inches. Fence assemblies that include only three cross members may be about four-feet tall (e.g., as measured from a ground to a top of a post of the fence assembly to/from which the three cross members extend), whereas fence assemblies that include only five cross members may be about six-feet tall (e.g., as measured from a ground to a top of a post of the fence assembly to/from which the five cross members extend).

The one or more brackets 212 may be coupled to the elongate body 204, via the one or more fasteners 224. A height of each of the one or more brackets 212 is adjustable, along the elongate body, with respect to the base 208. For example, a user of the fence assembly tool 200 may configure a height of each of the one or more brackets 212 to correspond to a desired height of a respective one or more cross members (e.g., cross members 108) of a fence assembly (e.g., fence assembly 100). Further, the one or more brackets 212 may comprise a plurality of brackets 212 that are each adapted to receive a corresponding one of a plurality of cross members (e.g., cross members 108) of a fence assembly (e.g., fence assembly 100).

Figure 4:
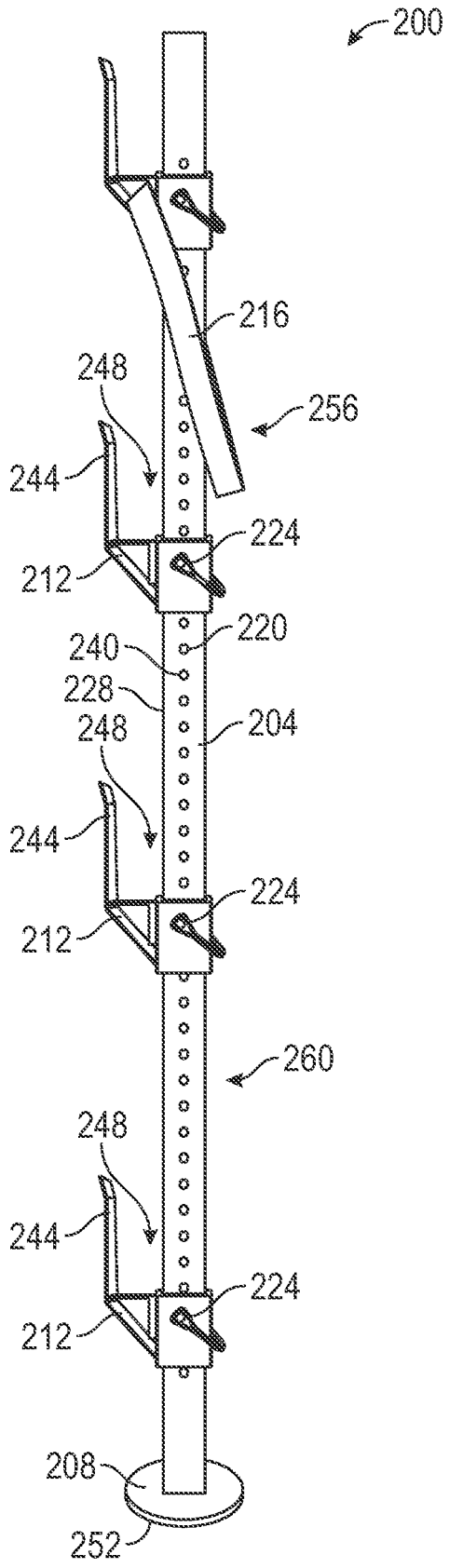
FIG. 4 illustrates a left-side perspective view of the fence assembly tool of FIG. 1, according to some aspects described herein.
Figure 5:
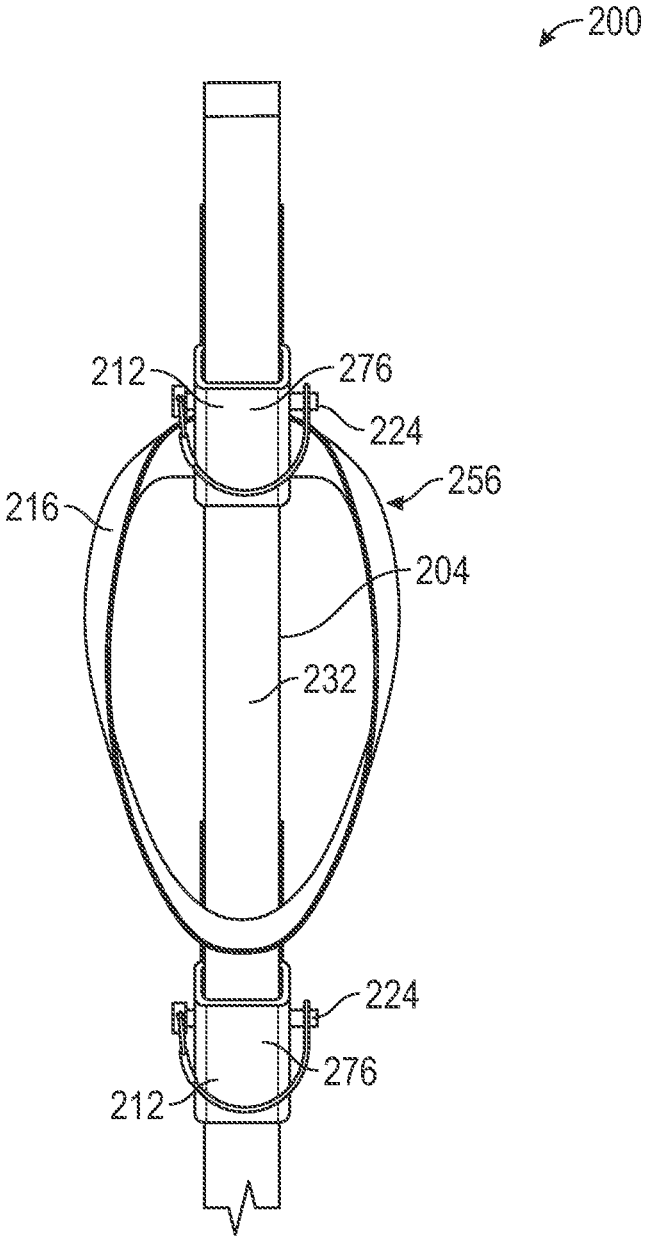
FIG. 5 illustrates a rear perspective view of a portion of the fence assembly tool of FIG. 1, according to some aspects described herein.

The elongate body 204 includes a first face or front face 228 (FIG. 3) and a second face or rear face 232 (FIG. 5). The first face 228 and the second face 232 are laterally opposed on the elongate body 204. The elongate body 204 further includes a third face or right face 236 (FIG. 6) and a fourth face or left face 240 (FIG. 4) that each extend between the first face 228 and the second face 232, on opposite sides of the elongate body 204. In some examples, the third face 236 and the fourth face 240 may extend substantially orthogonal between the first face 228 and the second face 232 to create a square or rectangular cross-section. The one or more brackets 212 each define a flange 244 (thereby, collectively, defining one or more flanges 244) that extends outward from the first face 228. Each of the one or more flanges 244 define, in combination with the elongate body 204, an elongate pocket 248 sized and configured to receive a cross member 108.

The one or more elongate pockets 248 may each receive the one or more cross members 108 (e.g., at the first end 112), when the fence assembly tool 200 is being used to assembly a fence. Therefore, the one or more brackets 212 may each be adapted to receive a corresponding one of the one or more cross members 108, within the elongate pocket 248. The one or more flanges 244 may curve away from, or otherwise extend away from, the elongate body 204 to form the elongate pocket 248. Accordingly, a face of each of the one or more flanges 244 may be spaced apart from the first face 228 of the elongate body 204 at a distance that is great enough to receive a thickness of a cross member of a fence assembly (e.g., one or more of the cross members 108 of the fence assembly 100).

FIGS. 4-8 illustrates additional views of the fence assembly tool 200, having been removed from the fence assembly 100. A height of the fence assembly tool 200 may be measured from the base 208 (e.g., a geometric center point of the base 208) to an end of the elongate body 204 that is furthest from the base 208. The height of the fence assembly tool 200 may be between about 4 feet and about 6 feet. Additionally or alternatively, the height of the fence assembly tool 200 may be about 3 feet, or about 4 feet, or about 5 feet, or about 6 feet, or about 7 feet, or any height within any range defined by any of the foregoing values. Generally, the fence assembly tool 200 may be tall enough to assist in coupling the tallest cross member of a fence assembly to one or more posts of the fence assembly. Additionally, or alternatively, the fence assembly tool 200 may be short enough for a person to comfortably carry (e.g., outside, for an extended period of time, and/or over long distances) when assembling fences, by themselves.

Figure 8:
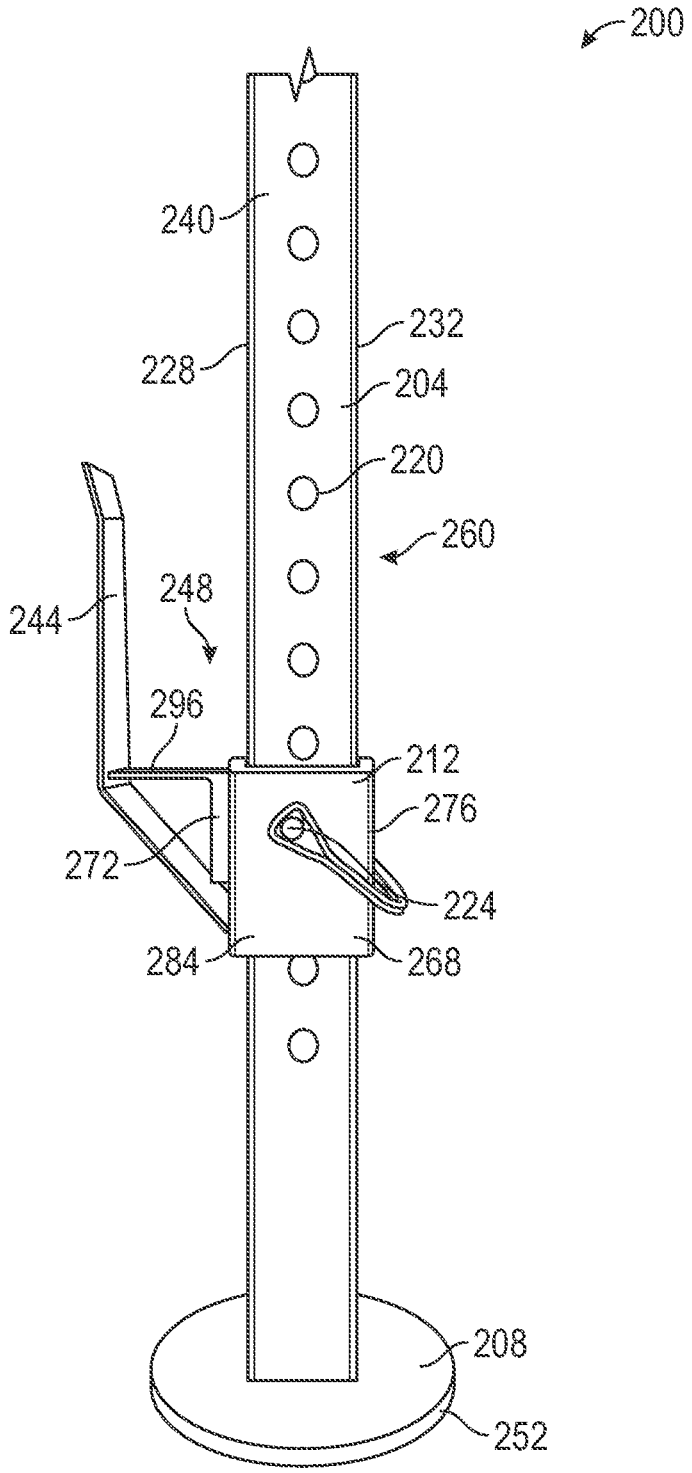
FIG. 8 illustrates a left-side perspective view of a portion of the fence assembly tool of FIG. 1, according to some aspects described herein.

Referring specially to FIGS. 4 and 8, the base 208 is attached to the elongate body 204. The base 208 may be integrally attached to the elongate body 204 and/or coupled to the elongate body 204. For example, the base 208 may be welded to the elongate body 204, molded with the elongate body 204, coupled to the elongate body 204 via fasteners, adhesion, snappable attachments, threaded attachments, or any other type of attachment that may be recognized by those of ordinary skill in the art.

The base 208 may provide support and stability to the elongate body 204, when the fence assembly tool 200 is in-use. The base 208 extends radially or laterally outward from the elongate body 204. In some examples, the base 208 extends substantially orthogonally outward from the elongate body 204. One or more peripheral edges 252 of the base 208 may define a perimeter of the base 208. The perimeter of the base 208 may form a circle, a square, a rectangle, an oval, or any other shape.

Figure 6:
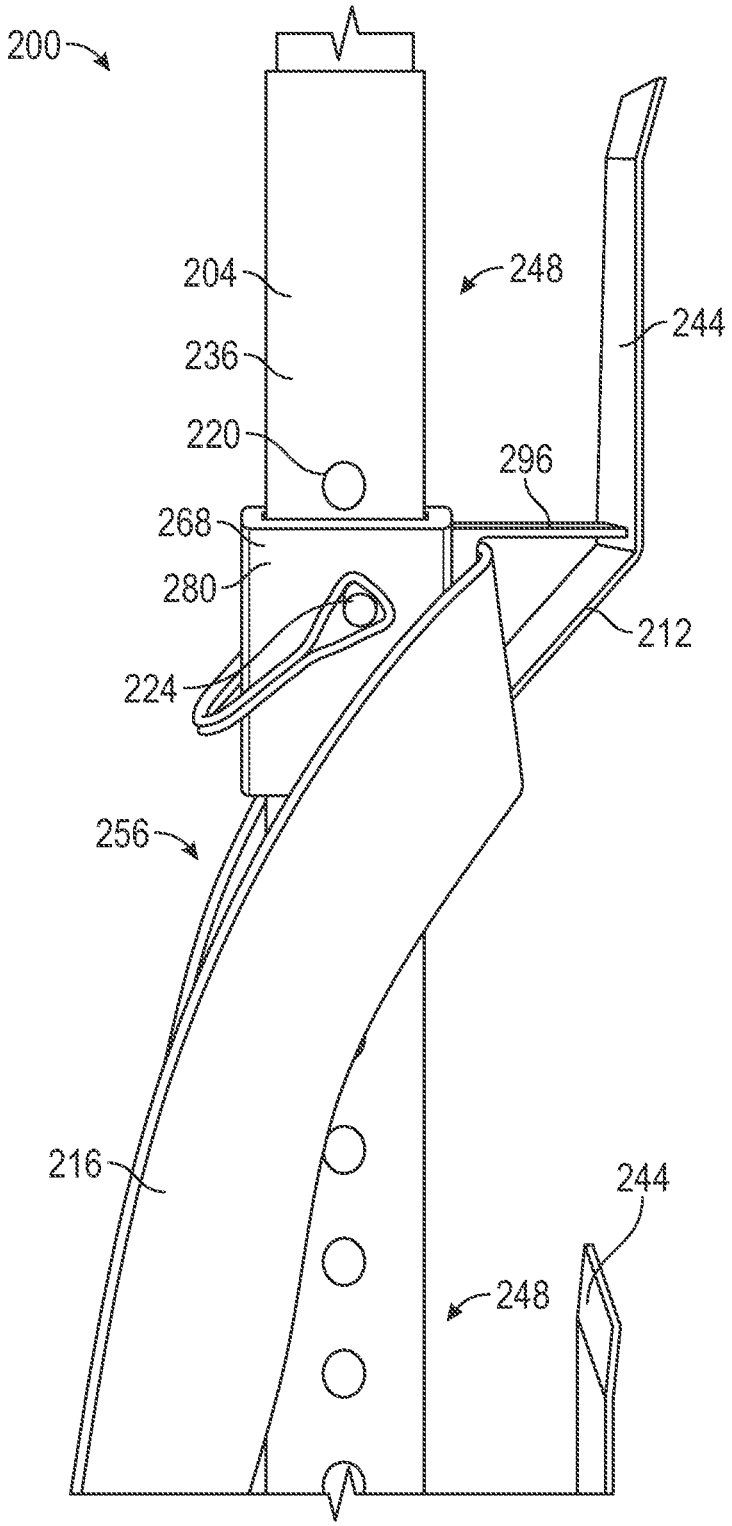
FIG. 6 illustrates a right-side perspective view of a portion of the fence assembly tool of FIG. 1, according to some aspects described herein.
Figure 7:
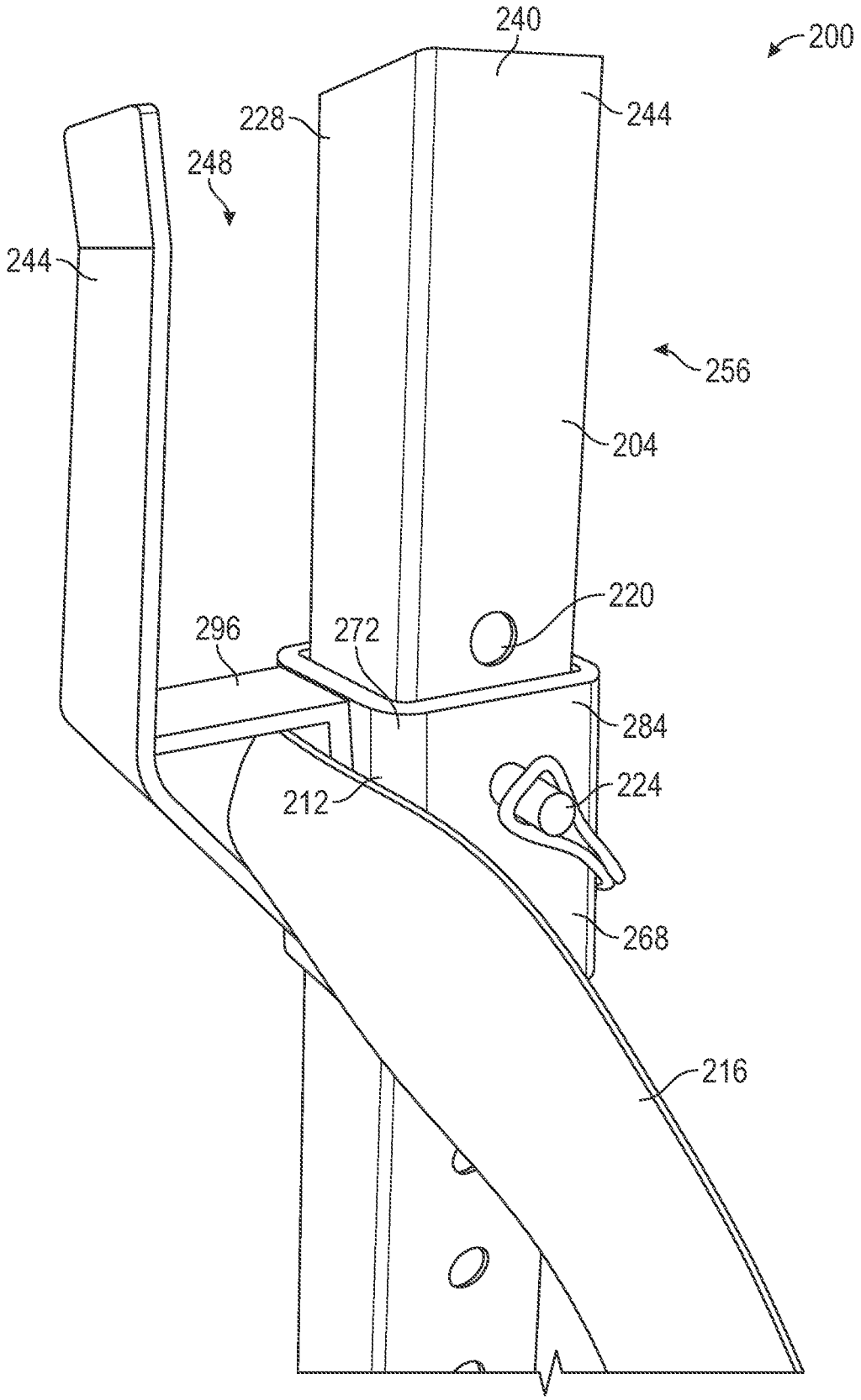
FIG. 7 illustrates a left-side perspective view of a portion of the fence assembly tool of FIG. 1, according to some aspects described herein.

Referring now to FIGS. 5-7, the strap 216 is shown in greater detail. The strap may be a cinch strap, a fabric strap, and/or a fabric strap with hook-and-loop fasteners (e.g., Velcro®). The strap 216 may be made of plastic (e.g., thermoplastic) and/or fabric (e.g., textile fibers). The strap 216 may be coupled to the elongate body 204. For example, the strap 216 may extend through one or more of the brackets 212. Additionally and/or alternatively, the strap may be fastened to the elongate body 204, adhesively coupled to the elongate body 204, and/or otherwise coupled to the elongate body 204.

The strap 216 is configured to removably couple the elongate body 204 to a fence post (e.g., one of the plurality of fence posts 104). For example, the strap 216 may extend from the first face 228 of the elongate body, across the third and fourth faces 236, 240 of the elongate body 204, and around a fence post that is adjacent to the second face 232 of the elongate body. Therefore, the strap 216 may be secured around both of the fence assembly tool 200 and a fence post, such as post 104 (FIG. 1), to provide a secure and stable coupling (e.g., temporary coupling) of the fence assembly tool 200 to the fence post. Accordingly, an individual may then couple one or more cross members (e.g., that are being held by the fence assembly tool 200) to one or more fence posts and/or trim a cross member that is being stably held by the fence assembly tool 200.

The elongate body 204 may include a first or upper half 256 and a second or lower half 260. The strap 216 may be coupled to the upper half 256 of the elongate body 204. Coupling the strap 216 to the upper half 256 of the elongate body 204 may improve stability of the tool 200 because the lower half 260 may be stabilized by the base 208 (e.g., friction between the base and a ground on which the base is disposed), while the upper half 256 is stabilized by the strap 216.

Figure 9:
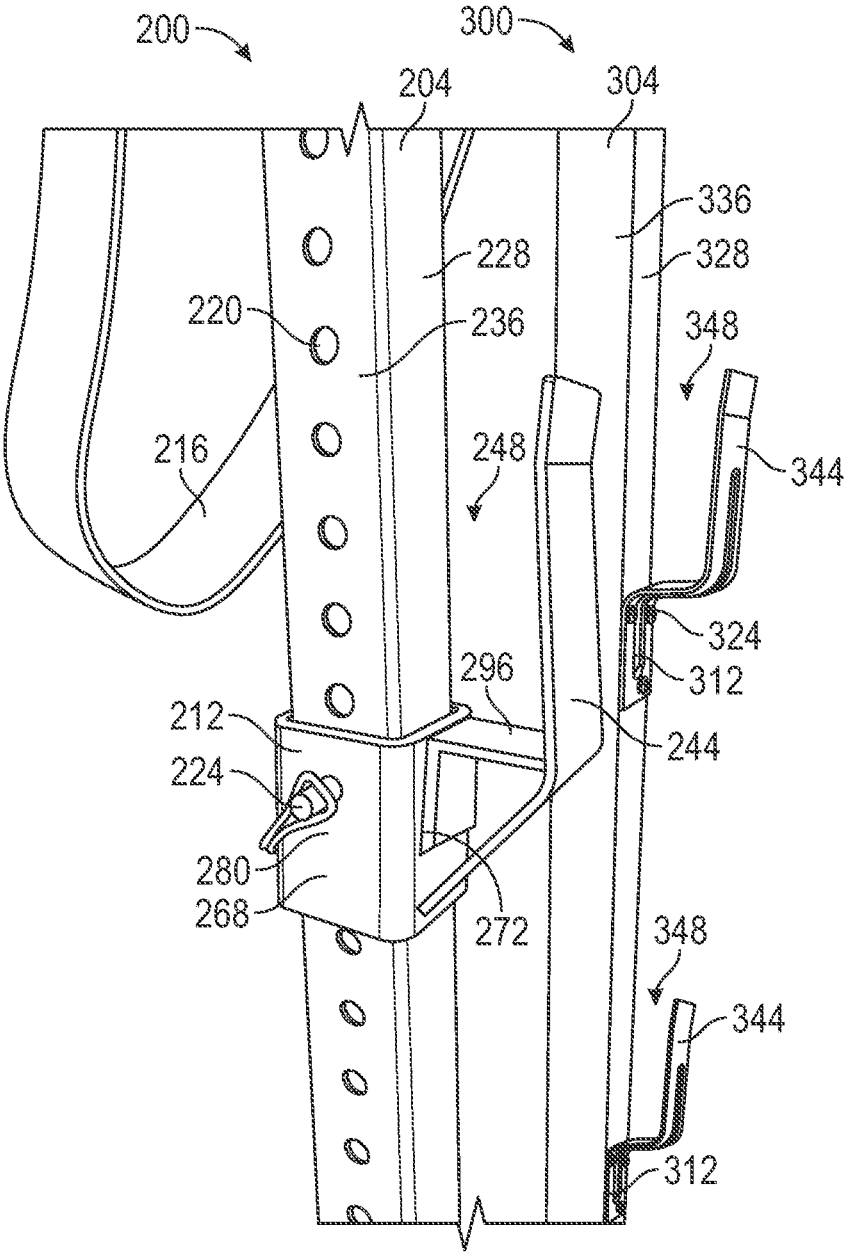
FIG. 9 illustrates a front, right-side perspective view of a portion of the first fence assembly tool of FIG. 1 and a portion of a second fence assembly tool, according to some aspects described herein.
Figure 10:
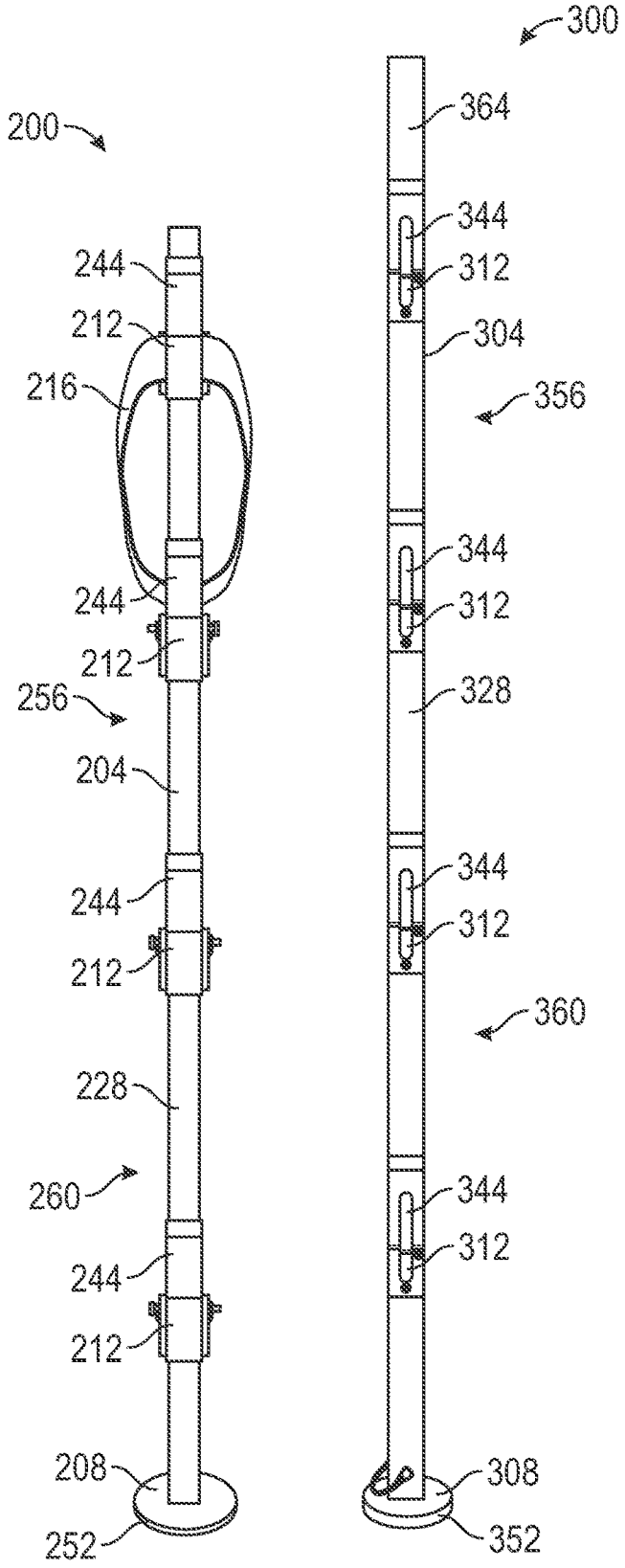
FIG. 10 illustrates a front perspective view of the first fence assembly tool and the second fence assembly tool of FIG. 9, according to some aspects described herein.

FIGS. 9 and 10 illustrate the fence assembly tool 200 adjacent to another embodiment of a fence assembly tool 300. In some aspects, the fence assembly tool 300 may be similar to the fence assembly tool 200, with similar parts being discussed with similar reference numbers (e.g., incremented by a value of 100). For example, the fence assembly tool 300 includes an elongate body 304, a base 308, one or more brackets 312, a plurality of holes 320, one or more fasteners 324, a first or front face 328, a second or rear face 332, a third or right face 336, a fourth or left face 340, a flange 344, an elongate pocket 348, one or more peripheral edges 352, an upper half or portion 356, and a lower half or portion 360.

However, in some aspects, the fence assembly tool 300 differs from the fence assembly tool 200. For example, the fence assembly tool 300 includes a handle 364. Further, as shown in FIGS. 1-10, the one or more brackets 212 of the fence assembly tool 200 extend around the elongate body 202. However, the one or more brackets 312 of the fence assembly tool 300 are coupled in a fixed relationship to the first or front face 328 of the elongate body 302, such that outer edges of the brackets 312 are disposed between outer edges of the front face 328. Still further, while the base 208 of the fence assembly tool 200 is shown to be integrally formed or otherwise fixed with the elongate body 204, the base 308 of the fence assembly tool 300 is shown to be removably coupled to the elongate body 304 (e.g., via a pin, lock pin, fastener, etc.).

Figure 11:
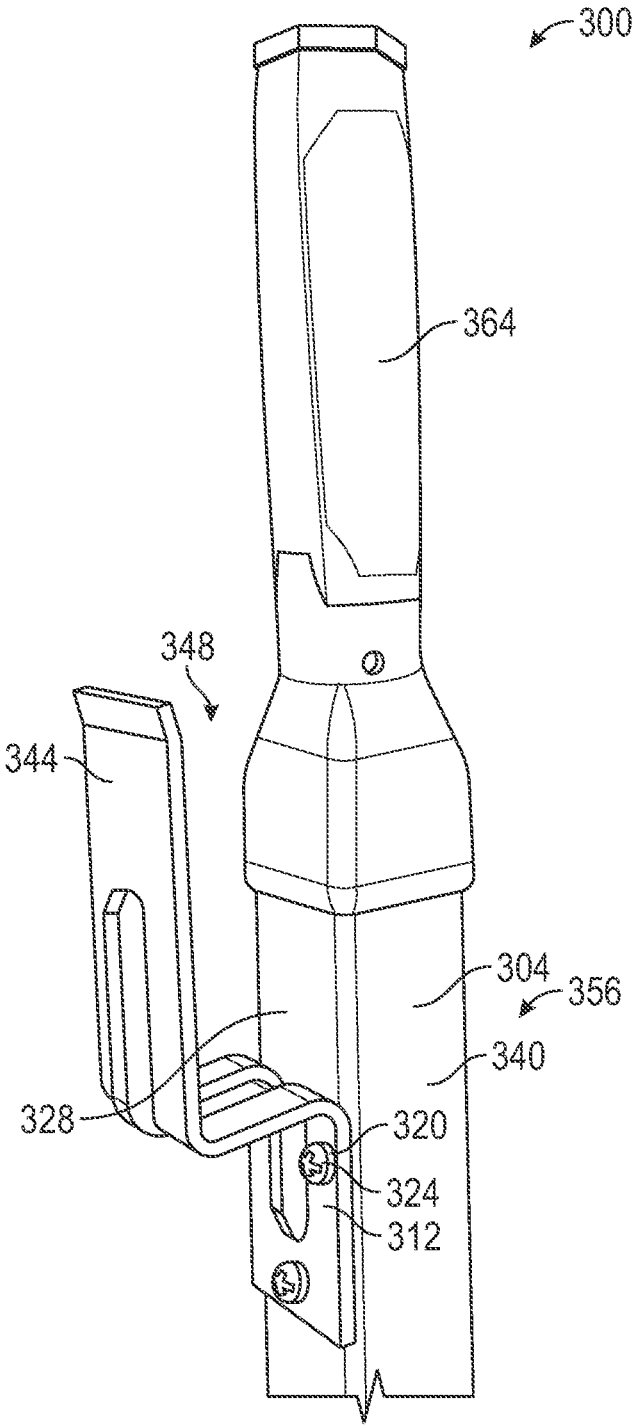
FIG. 11 illustrates a front, left-side perspective view of a portion of the fence assembly tool of FIG. 1, according to some aspects described herein.
Figure 12:
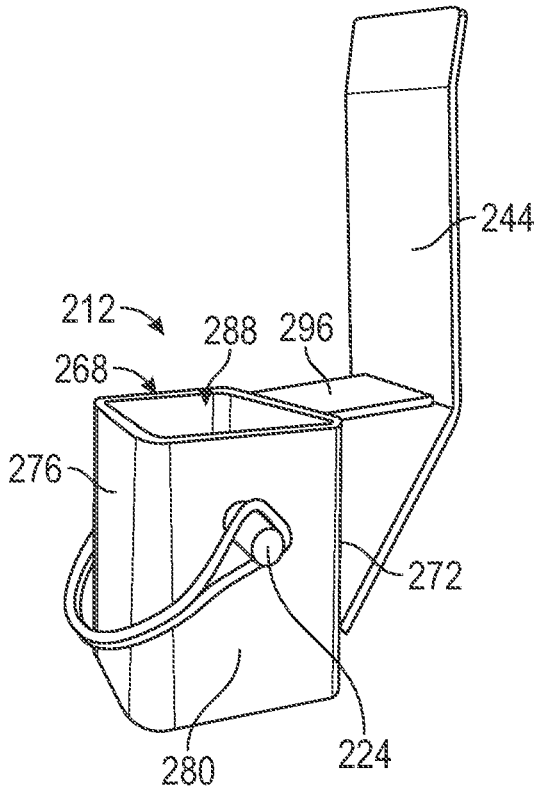
FIG. 12 illustrates a top, rear, and right-side view of a bracket for the fence assembly tool of FIG. 1, according to some aspects described herein.
Figure 13:
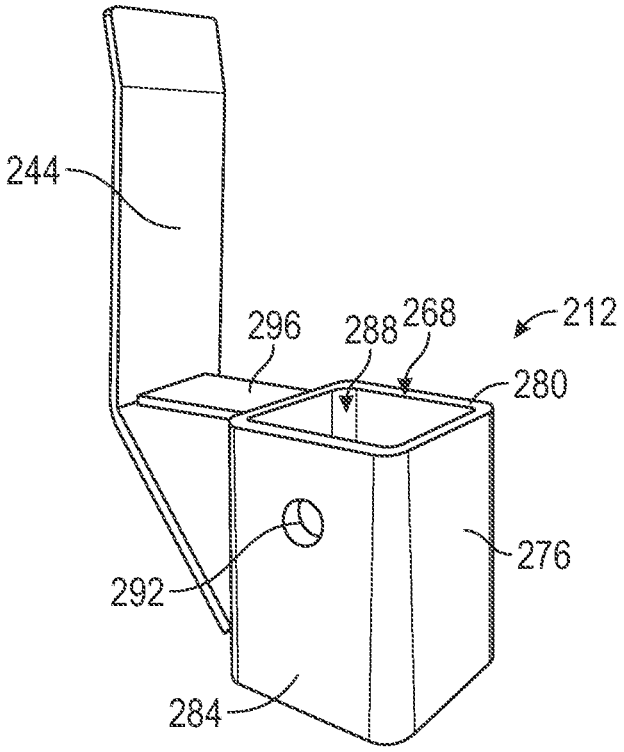
FIG. 13 illustrates a top, rear, and left-side view of a bracket for the fence assembly tool of FIG. 1, according to some aspects described herein.
Figure 14:
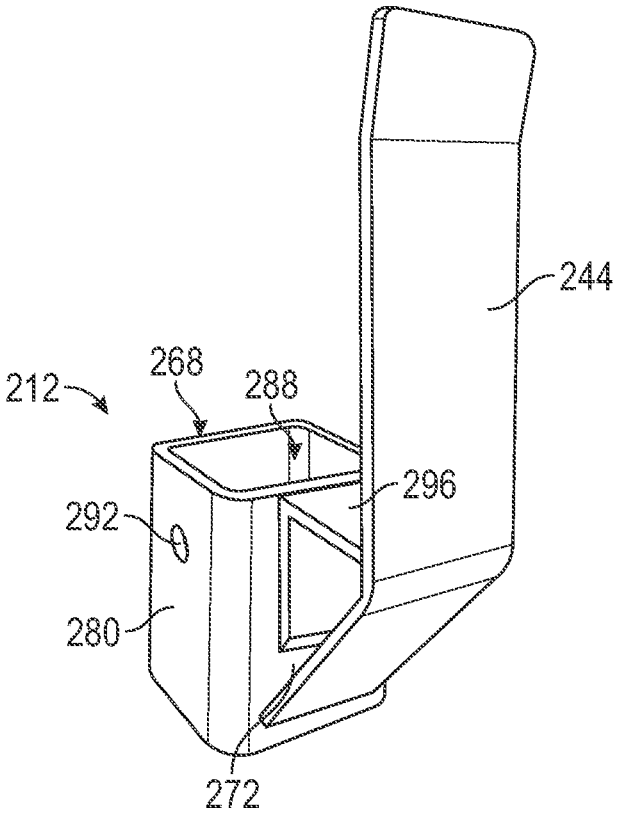
FIG. 14 illustrates a top, front, and right-side view of a bracket for the fence assembly tool of FIG. 1, according to some aspects described herein.
Figure 15:
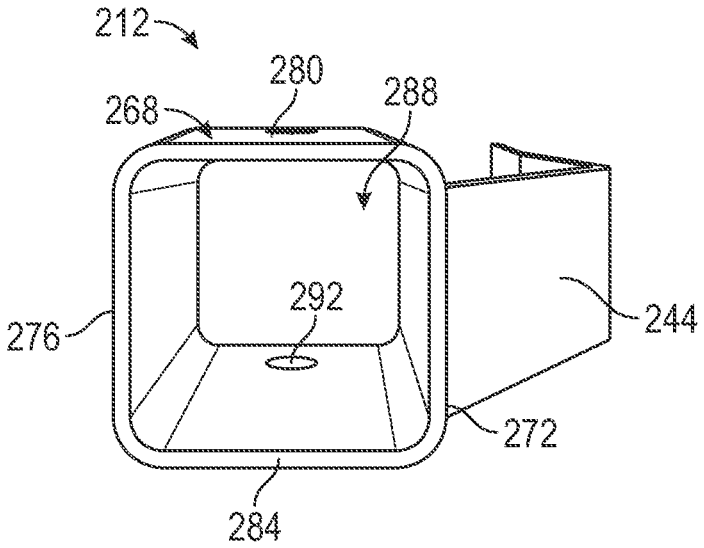
FIG. 15 illustrates a bottom perspective view of a bracket for the fence assembly tool of FIG. 1, according to some aspects described herein.
Figure 16:
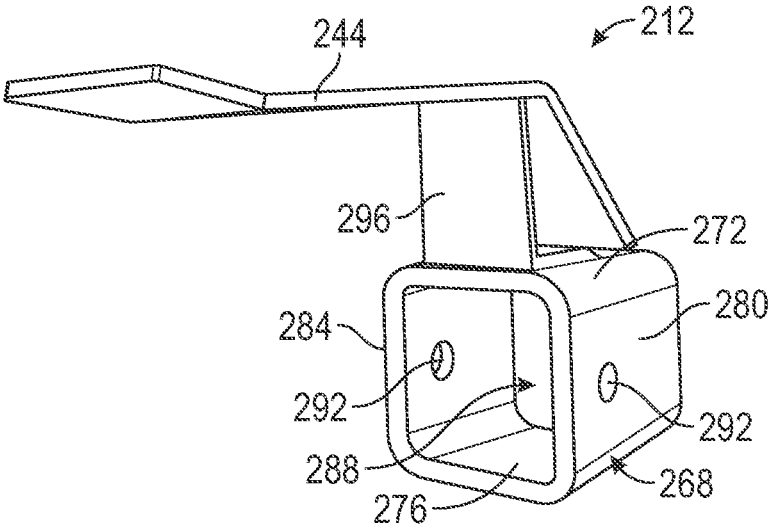
FIG. 16 illustrates a top, right-side view of a bracket for the fence assembly tool of FIG. 1, according to some aspects described herein.
Figure 17:
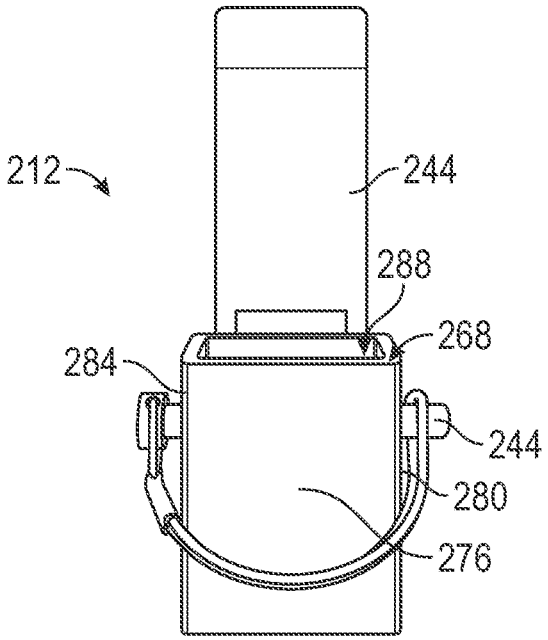
FIG. 17 illustrates a front perspective view of a bracket for the fence assembly tool of FIG. 1, according to some aspects described herein.

FIG. 11 illustrates the handle 364 of the fence assembly tool 300. The handle 364 extends upwardly from an upper end of the elongate body 304, opposite of the base 308. The handle 364 is attached to the elongate body 304. The handle 364 extends upwardly from the elongate body 304 in a direction that is substantially parallel to the elongate direction of the elongate body 304 (e.g., along an axis extending from the base 308 to the handle 364). The handle 364 may be texturized to improve a grip of a user who is holding the fence assembly tool 300, via the handle 364. Further, the handle 364 may be made of plastic and/or rubber. The handle 364 may be press fit onto the elongate body 304. Additionally, or alternatively, the handle 364 may be otherwise coupled to the elongate body, such as, for example, via molding, adhesive, fasteners, threading, snappable attachments, clips, buttons, etc.

A height of the fence assembly tool 300 is measured from the base 308 (e.g., a geometric center point of the base 308) to a point of the handle 364 that is furthest from the base 308. The height of the fence assembly tool 300 may be between about 4 feet and about 6 feet. Additionally or alternatively, the height of the fence assembly tool 300 may be about 3 feet, or about 4 feet, or about 5 feet, or about 6 feet, or about 7 feet, or any height within any range defined by any of the foregoing values. Generally, the fence assembly tool 300 may be tall enough to assist in coupling the tallest cross member of a fence assembly to one or more posts of the fence assembly. Additionally, or alternatively, the fence assembly tool 300 may be short enough for a person to comfortable carry (e.g., outside, for an extended period of time, and/or over long distances) when assembling fences, by themselves.

FIGS. 12-17 illustrates the bracket 212 of the fence assembly tool 200. As discussed earlier, bracket 212 defines flange 244. The bracket 212 also defines a bracket body 268 that includes a first or front bracket side or wall 272, a second or rear bracket side or wall 276, a third or right bracket side or wall 280, and a fourth or left bracket side or wall 284. The first bracket side 272, second bracket side 276, third bracket side 280, and fourth bracket side 284 define a channel 288 therebetween that is sized and configured to slidingly receive the elongate body 204 of the fence assembly tool 200.

The third bracket side 280 and the fourth bracket side 284 may each include a pin hole 292 extending therethrough. The pin hole 292 may be configured to receive the one or more fasteners 224 (e.g., a pin, lock pin, bolt, screw, etc.). For example, one of the one or more fasteners 224 may be slid through the pin hole 292 of the third bracket side 280 and through the pin hole 292 of the fourth bracket side 284. Therefore, the pin holes 292 of the third bracket side 280 and the fourth bracket side 284 may be concentric about an axis that extends through the center points of both of the pin holes 292.

The flange 244 may include a lower portion that extends outward, at an angle of about 45 degrees, from the front bracket side 272. In some examples, the flange 244 is a first flange, and the one or more brackets 212 further include a second flange 296. The second flange 296 extends orthogonally from the front bracket side 272 to the first flange 244. The second flange 296 provides structural support for the first flange 244 and also provides a flat surface at which a cross member of a fence assembly (e.g., fence assembly 100) may be received.

A width of the first flange 244 may be about the same as a width of the first bracket side 272. Alternatively, a width of the first flange 244 may be less than a width of the first bracket side 272. A height of the first flange 244 may be about three times a height of the first bracket side 272. Alternatively, a height of the first flange 244 may be greater than a height of the first bracket side 272. Additionally, or alternatively, a height of the first flange 244 may be greater than double the height of the first bracket side 272. Generally, the one or more brackets 212 are compact to securely and sturdily couple the first flange 244 to the elongate body 204 to define, in combination, the elongate pocket 248 that is configured and/or adapted to receive a cross member of a fence assembly (e.g., fence assembly 100).

Generally, as explained above, the present disclosure provides a fence assembly tool (e.g., fence assembly tool 200, 300). The fence assembly tool includes an elongate body and one or more brackets extending from the elongate body. Each of the one or more brackets are configured and/or adapted to receive one or more corresponding cross members of a fence assembly. In some examples, the fence assembly tool further includes a base. The base is attached to the elongate body. In some examples, the fence assembly tool further includes a handle. The handle extends from the elongate body. Further, in some examples, the fence assembly tool further includes a strap. The strap can be coupled to the elongate body, and the strap can be configured to removably couple the elongate body to a fence post.

Aspects of the fence assembly tool described herein provide the ability for a person to easily couple a cross member from a first fence post to a second fence post, by themselves. Further, aspects of the fence assembly tool provide a sturdy and stable structure for holding a cross member, such that the cross member can be easily trimmed by a person (e.g., with a saw, such as a hand saw), if needed, by themselves.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An assembly tool for a fence, comprising:

an elongate body;

a strap, the strap being coupled to the elongate body, and the strap being configured to removably couple the elongate body to a fence post;

a base, the base being attached to the elongate body; and one or more brackets extending from the elongate body, wherein each of the one or more brackets are sized and configured to receive a corresponding one of one or more cross members of a fence assembly.

2. The assembly tool of claim 1, wherein a height of each of the one or more brackets are adjustable, along the elongate body, with respect to the base.

3. The assembly tool of claim 1, wherein the elongate body is made from one of metal, wood, or plastic.

4. The assembly tool of claim 1, wherein the base is integrally attached to the elongate body.

5. The assembly tool of claim 1, wherein the one or more brackets are coupled to the elongate body, via one or more fasteners.

6. The assembly tool of claim 1, wherein the elongate body includes a plurality of holes extending therethrough, and wherein each of the plurality of holes are configured to receive one or more fasteners to secure the one or more brackets to the elongate body.

7. The assembly tool of claim 1, wherein the elongate body is substantially hollow.

8. The assembly tool of claim 1, wherein the one or more brackets comprise a plurality of brackets that are each adapted to receive a corresponding one of a plurality of cross member of a fence assembly.

9. The assembly tool of claim 1, wherein the elongate body includes a first face and a second face, the first face and the second facing being laterally opposed on the elongate body, and the one or more brackets each defining a flange that extends outward from the first face.

10. The assembly tool of claim 9, wherein each of the one or more flanges define, in combination with the elongate body, an elongate pocket.

11. The assembly tool of claim 1, wherein the strap is one of a cinch strap or a fabric strap with hook-and-loop fasteners.

12. The assembly tool of claim 1, further comprising a handle, the handle extending from the elongate body, opposite of the base.

13. The assembly tool of claim 12, wherein a height from the base to the handle is between about 4 feet and about 6 feet.

14. An assembly tool, comprising:

an elongate body;

a strap, the strap being coupled to the elongate body, and the strap being configured to removably couple the elongate body to a fence post; and one or more brackets extending from the elongate body, wherein each of the one or more brackets are adapted to receive a corresponding one of one or more cross members of a fence assembly.

15. The assembly tool of claim 14, wherein the strap is one of a cinch strap or a fabric strap with hook-and-loop fasteners.

16. The assembly tool of claim 14, further comprising:

a handle extending from the elongate body; and a base attached to the elongate body, opposite of the handle.

17. The assembly tool of claim 16, wherein a height from the base to the handle is between about 4 feet and about 6 feet.

18. A method for assembling a fence, using an assembly tool, the assembly tool comprising an elongate body and one or more brackets extending from the elongate body, the one or more brackets defining, in combination with the elongate body, one or more elongate pockets that are each sized and configured to receive a corresponding cross member of one or more cross members of the fence, the method comprising:

coupling the assembly tool to a first fence post;

inserting a first end of a cross member of the one or more cross members into a first elongate pocket of the one or more elongate pockets;

coupling a second end of the cross member to a second fence post;

de-coupling the assembly tool from the first fence post; and coupling the first end of the cross member to the first fence post.

19. The method of claim 18, wherein the elongate body includes a first face and a second face, the first face and the second face being laterally opposed on the elongate body, and the one or more brackets each defining a flange that extends outward from the first face.

20. The method of claim 18, wherein the assembly tool further comprises a strap, wherein the strap is coupled to the elongate body, and wherein the assembly tool is coupled to the first fence post via the strap.

* * * * *